US005329270A

United States Patent [19]

Freeman

[11] Patent Number: 5,329,270

[45] Date of Patent: Jul. 12, 1994

[54] TRANSFORMER CORE COMPRISING GROUPS OF AMORPHOUS STEEL STRIPS WRAPPED ABOUT THE CORE WINDOW

[75] Inventor: David R. Freeman, Hickory, N.C.

[73] Assignee: General Electric Company, Malvern, Pa.

[21] Appl. No.: 904,746

[22] Filed: Jun. 26, 1992

[51] Int. Cl.[5] ..... H01F 27/24; H01F 41/02

[52] U.S. Cl. ..... 336/213; 29/609; 336/217; 336/234

[58] Field of Search ..... 29/605, 606, 609; 336/216, 217, 233, 234, 213

[56] References Cited

U.S. PATENT DOCUMENTS 3,469,221 9/1969 Olson ..... 336/217
4,761,630 8/1988 Grimes et al. ..... 336/213
5,063,654 11/1991 Klappert et al. ..... 29/609

*Primary Examiner*—Thomas J. Kozma
*Attorney, Agent, or Firm*—Henry J. Policinski; William Freedman

[57] ABSTRACT

This transformer core comprises superposed groups of amorphous steel strip wrapped about the core window, each group comprising an inner section and an outer section disposed in superposed relationship, and each section comprising many thin layers of amorphous steel strip. Each of the layers in a section has a length dimension measured between the transversely-extending edges of the layer located at opposite ends of the section. The layers in the inner section of a group have substantially equal lengths, and the layers in the outer section of said group have substantially equal lengths of a greater value than the lengths of the layers in the inner section. At one end of each group the transversely-extending edges of all the layers in said group are substantially aligned to form a smooth edge. At the other end of the group (i) the transversely-extending edges of the layers in the inner section are disposed to form a beveled edge for the inner section, (ii) the transversely-extending edges of the layers in the outer section are disposed to form a beveled edge for the outer section, and (iii) the beveled edge of the outer section overlaps the beveled edge of the inner section.

6 Claims, 3 Drawing Sheets

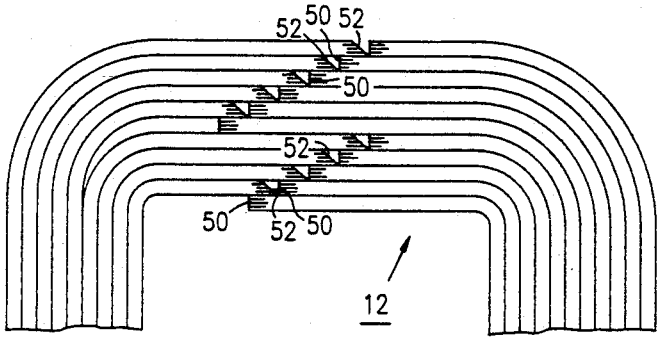
*Fig. 1*
PRIOR ART
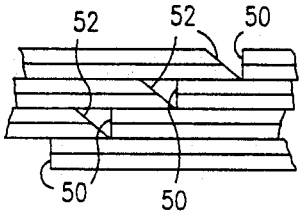
*Fig. 2*
PRIOR ART
*Fig. 3*
PRIOR ART
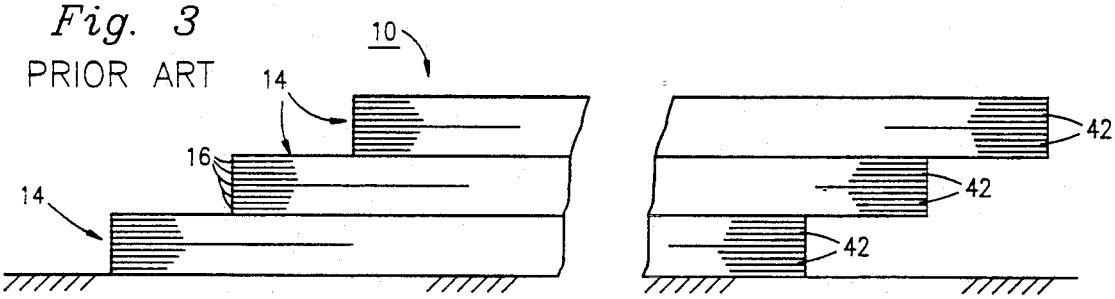
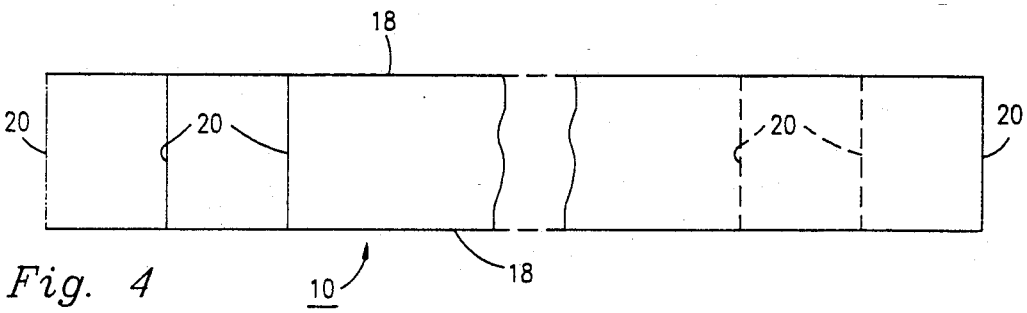
*Fig. 4*
PRIOR ART

TRANSFORMER CORE COMPRISING GROUPS OF AMORPHOUS STEEL STRIPS WRAPPED ABOUT THE CORE WINDOW

CROSS-REFERENCE TO RELATED PATENT AND APPLICATION

This invention is related to the inventions described and claimed in the following patent and application, which are incorporated by reference in the present application:

U.S. Pat. No. 5,063,654—Klappert and Freeman issued Nov. 12, 1991.

Application Ser. No. 07/623,265—Klappert and Houser filed Dec. 6, 1990, a continuation of which issued on Jul. 27, 1993, as U.S. Pat. No. 5,230,139.

TECHNICAL FIELD

This invention relates to a core for an electric transformer and, more particularly, relates to a core that comprises a window and groups of amorphous steel strips wrapped about the core window. The invention also relates to a method of making such a core.

BACKGROUND

In the above-cited U.S. Pat. No. 5,063,654, there is disclosed a method of making an amorphous steel transformer core that involves making up packets of amorphous steel strip and then wrapping these packets about an arbor to build up a core form. When the core form is removed from the arbor, it has a window where the arbor was located, and the packets surround this window. Each packet comprises a plurality of superposed groups of amorphous steel strip, and each group comprises two superposed sections, each of which comprises many thin layers of strip.

Each multi-layer section of strip is derived from composite strip comprising many thin layers of strip disposed in superposed relationship. The composite strip is cut into sections of controlled length, the layers in each section having transversely-extending edges at their opposite ends and a length dimension measured between said transversely-extending edges at opposite ends. Each group is assembled by stacking two of these sections together. In U.S. Pat. No. 5,063,654 the two sections forming a given group are cut to the same length and are stacked together with the transversely-extending edges of their layers at each end in alignment, thus forming a group that has squared-off edges at its opposite ends.

When the above-described group of U.S. Pat. No. 5,063,654 is wrapped about the arbor of a core-making machine to produce a core form, the transversely-extending edges of the layers at one end of the group are maintained in substantial alignment, thus retaining the substantially squared-off edge at one end of the group. But at the other end of the group, the transversely-extending edges of the layers become staggered as a result of the larger circumference of the core form at the outer layers compared to that at the inner layers. As a result of this staggering, the edge of the group is forced into a beveled configuration, as shown at 52 in FIGS. 1 and 2 of the present application.

I have found that this beveled configuration is disadvantageous from a core-loss viewpoint, whether the joint is a lap-type joint or a butt-type joint. In the case of the lap joint, where the ends of each group overlap to form the lap joint, this beveled configuration appears to introduce a thinness in the magnetic circuit at a crucial location where steel is needed to produce ideal flux transfer. In the case of the butt joint, the beveled configuration introduces a relatively large V-shaped gap between the substantially-aligned, transversely-extending edges of the group, which gap detracts from ideal flux transfer between the aligned ends.

OBJECTS

An object of my invention is to provide, in an amorphous steel core that is made by wrapping about the core window multi-layer groups of amorphous steel strip cut to controlled lengths from composite strip, joints between the ends of the groups that exhibit exceptionally low core loss.

Another object is to provide, in the type core referred to in the preceding object, lap joints that exhibit lower core loss than is exhibited by the type of lap joints present in corresponding locations in the core of U.S. Pat. No. 5,063,654 (where one end of each group terminates in a single beveled edge), assuming that the amount of overlap is the same in the two types of lap joints.

Another object is to achieve, with less overlap in each lap joint than is present in the lap joint of U.S. Pat. No. 5,063,654, core loss no greater than characterizes the lap joints of the patent. Reducing the amount of overlap present in each lap joint enables more lap joints to be present in a given length of core, thus reducing the size of the usual hump present in the core where the lap joints are located.

SUMMARY

In carrying out my invention in one form, I provide a transformer core comprising superposed groups of amorphous steel strip wrapped about the window of the core, each group comprising an inner section and an outer section disposed in superposed relationship, and each section comprising many thin layers of amorphous steel strip. Each of the layers in a section has transversely-extending edges at opposite ends of the section and a length dimension measured between the transversely-extending edges at opposite ends of the section. The core is further characterized by the layers in the inner section of a group having substantially equal lengths, and the layers in the outer section of said group having substantially equal lengths of a greater value than the lengths of the layers in the inner section. At one end of each group, the transversely-extending edges of all the layers in said group are substantially aligned to form a relatively smooth edge at said one end of the group. At the other end of each group, (i) the transversely-extending edges of the layers in the inner section are disposed to form a beveled edge for said inner section, (ii) the transversely-extending edges of the layers in the outer section are disposed to form a beveled edge for said outer section, and (iii) the beveled edge of said outer section overlaps the beveled edge of said inner section.

In one embodiment of the invention, one end of each group overlaps the other end of said group to form a lap joint between the ends of said group, and the overlapping end of each group includes the beveled edges of the inner and outer sections of the group. The beveled edges of a group are located immediately adjacent the smooth edge of the next radially-outwardly succeeding group.

In practicing one form of the method of my invention, I derive the above-described sections forming each group from composite strip comprising many thin layers of amorphous steel strip. One of the sections is derived by cutting the composite strip to form a multi-layer section of predetermined length, and the other of the sections is derived by cutting the composite strip to form a multi-layer section of a greater length than said predetermined length. The two sections are stacked together (i) with their edges at one end of the two sections in substantial alignment to form a group having a relatively smooth edge at said one end and (ii) with the edges within each section aligned at the other end of the two sections but with the edges of one section staggered with respect to the edges of the other section. The group is then wrapped about an arbor (i) while maintaining the smooth edge configuration at one end of the group, and (ii) with the longer section located radially outwardly of the other section. The result of the wrapping is at said other end of the group, each of the two sections develops a beveled edge, with the beveled edge on the outer section overlapping the beveled edge on the inner section.

BRIEF DESCRIPTION OF FIGURES

FIG. 1 is a sectional view of the yoke portion of a prior art amorphous metal core. This yoke portion contains distributed lap joints.

FIG. 2 is an enlarged view of some of the lap joints of the FIG. 1 core.

FIG. 3 is an enlarged side elevational view of a packet of amorphous metal strip used in manufacturing the prior art amorphous steel core of FIGS. 1 and 2.

FIG. 4 is a plan view of the packet of FIG. 4.

DESCRIPTION OF PRIOR ART

The type of transformer core that I am concerned with is made by wrapping about the arbor of a core-making machine a plurality of packets of amorphous steel strip material. A typical prior art form of one of these packets is shown at 10 in FIGS. 3 and 4, and a core that is made with such packets is illustrated at 12 in FIG. 1. The packet shown in FIGS. 3 and 4 comprises three groups 14 of amorphous steel strip material, each group comprising many thin layers 16 of amorphous steel strip stacked in superposed relationship. Each layer has longitudinally-extending edges 18 at its opposite sides and transversely-extending edges 20 at its opposite ends. In the prior art construction shown in FIGS. 3 and 4, the layers 16 in each group have their longitudinally-extending edges 18 at each side disposed in alignment and their transversely-extending edges 20 at each end of the group disposed in alignment.

Figure 9:
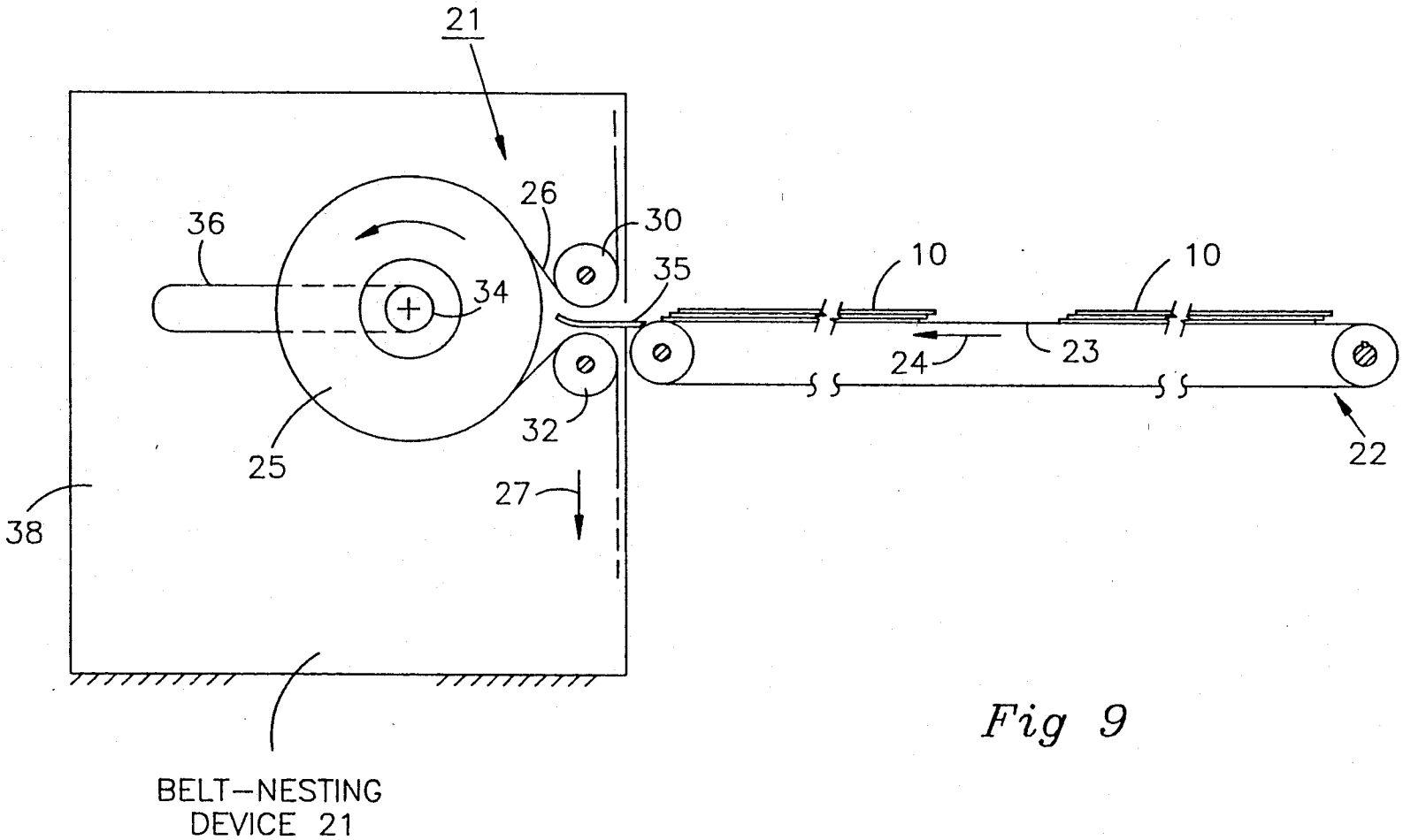
FIG. 9 is a schematic illustration of a core-making machine of the belt-nesting type that is used for wrapping packets about the arbor of the core-making machine.

I prefer to use a core-making machine of the belt-nesting type shown and claimed in application Ser. No. 623,265—Klappert and Houser, filed Dec. 6, 1990, a continuation of which issued on Jul. 27, 1993, as U.S. Pat. No. 5,230,139, assigned to the assignee of the present invention. Some features of this machine are generally illustrated in FIG. 9. For example, the machine of FIG. 9 comprises a belt-nesting device 21 into which the above-described packets 10 are fed by a conveyer system 22 comprising a belt drive 23 that transports the packets in the direction of arrow 24. The belt-nesting device 21 comprises a rotatable arbor 25 having a horizontal axis encircled by a flexible belt 26. Individual packets 10 of strips are guided into the space between the belt and arbor, where they are wrapped about the arbor as the belt 26 moves in the direction of arrow 27 to rotate the arbor in a counter-clockwise direction. Where the packets of strips enter the space between the belt and the arbor, there are two vertically-spaced front rollers 30 and 32 about which the belt 26 is partially wrapped. A thin guide 35 directs the packets generally upward as they enter the gap between the rollers. The rollers 30 and 32 serve as guide rollers for the belt 26 and are rotatable mounted on fixed axes. As shown in the aforesaid Klappert and Houser application Ser. No. 623,265, the belt 26 is an endless flexible belt that extends externally of the arbor 25 and guide rollers 30 and 32 around a series of additional guide rollers, tensioning rollers, and a motor-driven pulley (none of which are shown in the present application) to enable the belt to be appropriately driven as shown. The arbor 25 is supported on a shaft 34 which is slidably mounted in slots 36 in stationary support members 38. As the core form is built up about the arbor, the shaft 34 is forced to shift to the left in the slots 36 against the opposing bias of the belt-tensioning device (not shown), thus providing room for new packets of strips fed onto the arbor. The Klappert and Houser application illustrates in more detail how the individual packets are fed into the belt-nesting device and wrapped one at a time about the arbor.

After a toroid of the desired build has been formed in the belt-nesting device 21, this toroid is removed from the arbor 25 of the belt nesting device and is suitably shaped in a conventional manner, as by core-shaping apparatus (not shown) in which appropriately configured tools are inserted into the core window and are then forced apart. Thereafter, the shaped core form is placed in an annealing oven, where it is heated and then slowly cooled to relieve stresses in the amorphous steel strip material. These shaping and annealing steps are both conventional and are not illustrated in the drawings.

In a typical prior art packet (10), each of the groups 14 present therein comprises 30 layers of amorphous steel strip, each layer being about 0.001 inch thick. These groups are derived from one or more continuous lengths of composite strip (not shown). Typically, this composite strip is 15 layers thick. Two sections of the required length are cut from the composite strip, and these two sections (shown at 42 in FIG. 3) are stacked together to form a group 14. The typical prior art approach is to cut each of the two sections 42 that constitute a group to the same length and to stack the two sections together so that their transversely-extending edges 20 at opposite ends of the group are aligned. Thus, when the group 14 is in its flat, unwrapped state, as shown in FIGS. 3 and 4, the transversely-extending edges 20 of all the layers in the group are aligned.

In the typical prior art approach, the two sections 42 constituting each individual group are cut to the same length, but the groups are cut to different lengths to compensate for the increasing build of the core. More specifically, proceeding in a radially-outward direction in the core (or from bottom to top in FIG. 3), each group is made longer than its immediately-preceding group by an amount of $2\pi T$, where T is the thickness of the immediately preceding group. Where the immediately-preceding group is a 30-strip group, each strip having a thickness of 0.001 inch, the next succeeding group is made longer by $2\pi \times 30 \times 0.001$ or 0.188 inch. Thus, each group is long enough to encircle the progressively increasing circumference of the core as the core is built up by the inclusion of additional groups.

When the packet of FIGS. 3 and 4 is made in accordance with the immediately-preceding paragraph, the intermediate group 14 will be 0.188 inches longer than the bottom group, and the top group 14 will be 0.188 inches longer than the intermediate group. This assumes that the bottom group will be the one closest to the core window in the final core and top group will be the one furthest radially-outward from the core window.

When the groups 14 are dimensioned and incorporated as described in the immediately-preceding two paragraphs, the joints in the final core will have the appearance illustrated in FIGS. 1 and 2. More specifically, at one end of each group the transversely-extending edge of all the layers in the group will be aligned to form a smooth squared-off edge (as shown at 50), and at the other end of the group the edges of the layers in the group will be located to form a single-beveled edge (as shown at 52) for the group.

I have found that the above-described single beveled edge configuration leaves something to be desired from a core-loss viewpoint, even in a lap joint, where the ends of each group overlap to form the lap joint. The single beveled configuration appears to introduce a thinness in the magnetic circuit at a crucial location where steel is needed to produce ideal flux transfer.

Figure 5:
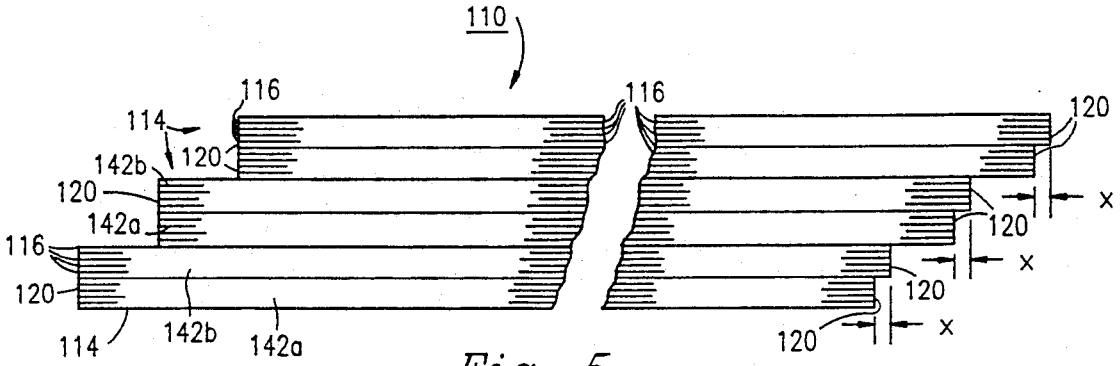
FIG. 5 is an enlarged side elevational view of a packet of amorphous steel strip used in manufacturing an amorphous steel core embodying one form of my invention.
Figure 6:
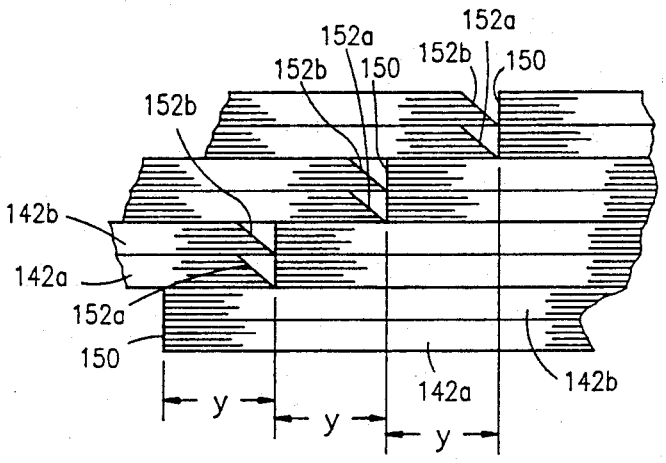
FIG. 6 is an enlarged view of lap joints produced when the packet of FIG. 5 is wrapped about the window of a core as part of my core-manufacturing process. The groups in the packet of FIG. 5 are made long enough to have overlapping ends when wrapped about the core window.

I have found that I can reduce the core loss by modifying the groups and the resulting lap joints in the manner illustrated in FIGS. 5 and 6. In these latter figures, parts that correspond to similar parts in FIGS. 1–4 have been assigned corresponding reference numerals except with the prefix "1" included. More particularly, in FIG. 5 there is shown a packet 110 comprising a stack of three multi-layer groups 114, each group comprising two sections 142*a* and 142*b*, and each section comprising many layers 116 (e.g. 15 layers) of thin amorphous steel strip with a thickness of about 0.001 inch per layer. In each individual section 142*a* or 142*b*, the layers 116 have the same length (as measured between their transversely-extending edges 120 at opposite ends of the section) and have their transversely-extending edges 120 aligned at opposite ends of the section. The layers in the two different sections 142*a* and 142*b* forming a group are not, however, of equal length as in FIGS. 1–4. More specifically, in each of the groups 114 depicted in FIG. 5, the layers 116 in the upper section 142*b* have a length greater than that of the layers 116 in the lower section 142*a*. In a preferred embodiment, this difference in lengths is $2\pi T$, where T is the thickness of the lower section 142*a*. Thus, where each of the sections 142*a* and 142*b* is 15 strips in thickness, the layers in the upper section 142*b* have a length exceeding the length of the layers in the lower section 142*a* by $2\pi \times 0.015$ inch or 0.094 inch. This difference in lengths is designated x in FIG. 5.

In the packet of FIG. 5, the lower section 142*a* of the intermediate group 14 is made longer than the upper section 142*b* of the lower group 14 by an amount $2\pi T$, where T is the thickness of the upper section 142*b* of the lower group. Since T is equal to 0.015, the difference in lengths is 0.094 inch. Similarly, the lower section 142*a* of the upper group 14 is made longer than the upper section of the intermediate group by an amount 0.094 inch. It will thus be apparent that throughout the packet, each successive section, proceeding upwardly, is 0.094 inches longer than the section immediately beneath it.

When the packet of FIG. 5 is wrapped about the arbor of a core-making machine as shown in FIG. 9, the lap joints in the core form have the configuration depicted in FIG. 6. At one end of a wrapped group, the layers in the two sections have all their edges aligned in a substantially smooth, squared-off edge configuration as shown at 150 in FIG. 6. But at the other end of the wrapped group, the edges of the inner section 142*a* are staggered to form a first beveled edge 152*a*, and the edges of the outer section 142*b* are staggered to form a second beveled edge for the outer section. The beveled edge 152*b* for the outer section overlaps the beveled edge 152*a* for the inner section, as best seen in FIG. 6.

It will be apparent that for a given amount of overlap Y between the ends of a group, the edge configuration of FIG. 6 results in more steel being present in the crucial overlap region in the FIG. 6 joint than is the case for the prior art joint of FIG. 2. This extra steel in this region provides for more sharing among the layers of the flux passing between the lapped ends of the group, thereby reducing the chances that this flux will saturate the layers in this region. Accordingly, for a given amount of overlap between the ends of a group, the joints of FIG. 6 have a lower core loss than the joints of FIG. 2.

In some applications the core-loss performance of the FIG. 2 arrangement is satisfactory. Even in such applications, I can advantageously utilize my invention by reducing the dimension Y of FIG. 6 to such an extent that the core losses in the FIG. 6 joints are equal to those in the FIG. 2 joints. This reduced space requirement for each joint enables me to incorporate more joints in a given length of the core. Accordingly, I can incorporate more groups in each packet of the core without increasing the core loss. With more groups in each packet, I can reduce the number of packets in the core. Reducing the number of packets in the core is advantageous because it allows for a reduction in the size of the usual hump that is present in the core in the joint region.

Figure 7:
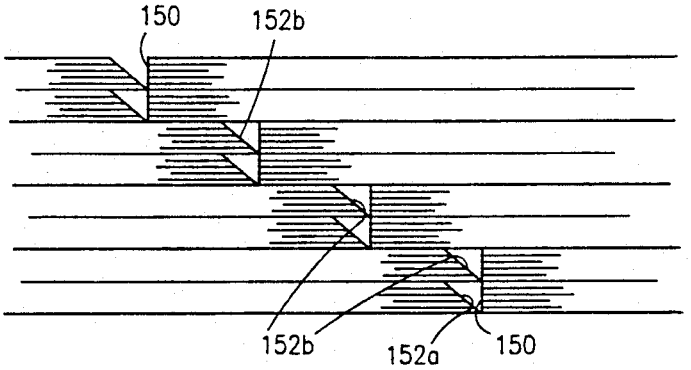
FIG. 7 is an enlarged view of butt joints produced when the packet of FIG. 5 is wrapped about a core window that is of such size that butt joints are formed between non-overlapping ends of each group in the packet.
Figure 8:
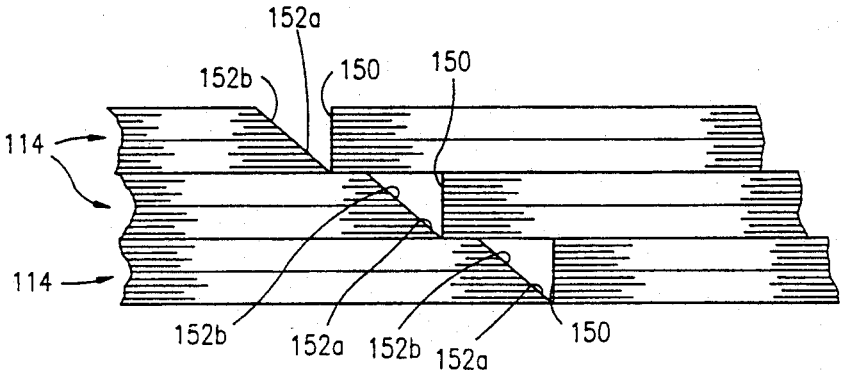
Fig. 8 PRIOR ART
FIG. 8 is an enlarged view of butt joints produced when the prior art packet of FIG. 3 is wrapped about a core window that is of such size that butt joints are formed between non-overlapping ends of each group in the packet.

The above-described double bevel construction for the end of a group is advantageous not only for cores of the lap-joint type, as described above, but also for cores of the butt-joint type. FIGS. 7 and 8 illustrate butt-joint types of cores, FIG. 8 the prior art type and FIG. 7 one embodying the present invention. In both of these butt-joint types of core, a substantial portion of the flux passes directly between the aligned ends of a group. The closer these ends are together, the lower will be the core loss for this joint. The double bevel configuration of FIG. 7 enables the edge 152*b* to be located in close proximity to the squared-off edge 150, thus reducing the effective length of the gap in this region as compared to a construction in which there is no overlapping between edge 152*b* and 152*a*, as exemplified by the prior art construction of FIG. 8.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A transformer core comprising a window and superposed, staggered groups of amorphous steel strip wrapped about the window, each group comprising an inner section and an outer section disposed in superposed relationship, and each section comprising many thin layers of superposed amorphous steel strip, the core being further characterized by:

(a) each of the layers in a section having transversely-extending edges at opposite ends of the section and a length dimension measured between the transversely-extending edges at opposite ends of the section, (b) the layers in the inner section of a group having substantially equal lengths and the layers in the outer section of said group having substantially equal lengths of a greater value than the lengths of the layers in the inner section, (c) at one end of each group the transversely-extending edges of all the layers in said group being substantially aligned and forming a smooth edge at said one end of said group, (d) at the other end of each group (i) the transversely-extending edges of the layers in said inner section being disposed to form a beveled edge for said inner section, (ii) the transversely-extending edges of the layers in said outer section being disposed to form a beveled edge for said outer section, and (iii) the beveled edge of said outer section overlapping the beveled edge of said inner section.

2. A core as defined in claim 1 and further characterized by:

(a) said other end of each group overlapping said one end of said group to form a lap joint between said ends, (b) the overlapping end of each group including the beveled edges on the inner and outer sections, and (c) the beveled edges of a group being located in substantially abutting relationship with said smooth-edge end of the next radially-outwardly succeeding group.

3. A core as defined in claim 2 and further characterized by said groups being arranged in packets in each of which packets said lap joints are staggered angularly of said core.

4. A core as defined in claim 1 and further characterized by the layers in said outer section having a length which exceeds the length of the layers in said inner section by an amount substantially equal to $2\pi T$, where T is the thickness of said inner section.

5. A core as defined in claim 1 and further characterized by:

(a) said two ends of each group disposed in substantially aligned relationship, and (b) said end of each group that includes the beveled edges on the inner and outer sections of the group being located in substantially abutting relationship with the smooth edge on the other end of said group.

6. A core as defined in claim 1 in which at said one end of each group the substantially aligned edges of the layers in said group form a squared-off edge of said group.

* * * * *